US006938800B1

(12) United States Patent
Lehmkuhl

(10) Patent No.: US 6,938,800 B1
(45) Date of Patent: Sep. 6, 2005

(54) AUTOMATIC DISPENSING CAP FOR SQUEEZABLE BOTTLE

(76) Inventor: Robert A. Lehmkuhl, 3027 Stratford Ct., Loveland, OH (US) 45140

( * ) Notice: Subject to any disclaimer, the term of this patent is extended or adjusted under 35 U.S.C. 154(b) by 0 days.

(21) Appl. No.: 10/856,337

(22) Filed: May 28, 2004

Related U.S. Application Data

(60) Provisional application No. 60/473,991, filed on May 28, 2003, provisional application No. 60/474,079, filed on May 28, 2003.

(51) Int. Cl.[7] ..... B05B 11/24
(52) U.S. Cl. ..... 222/153.14; 222/212; 222/496
(58) Field of Search ..... 222/153.14, 212, 222/481.5, 518, 559, 496

(56) References Cited

U.S. PATENT DOCUMENTS 4,408,702 A * 10/1983 Horvath ..... 222/212
4,739,906 A * 4/1988 LoTurco ..... 222/496
4,785,978 A * 11/1988 Kano et al. ..... 222/496

* cited by examiner

*Primary Examiner*—Philippe Derakshani
(74) *Attorney, Agent, or Firm*—Carol D. Titus; James J. Leary

(57) ABSTRACT

The non-vented automatic dispensing cap is generally formed of a body and a retainer cap. The body is threadably secured to a squeezable tube or container. The retainer cap is attached to the body. A pressure chamber is formed between the body and retainer cap. A piston may also form a wall of the pressure chamber. A coil spring or resilient flange holds a valve seated within a dispensing hole extending through the cap. When the tube is squeezed, the product is forced into the pressure chamber expanding the pressure chamber and unseating the valve, thereby allowing product to exit the dispensing opening. Upright, inverted, vented and unvented versions are disclosed.

20 Claims, 11 Drawing Sheets

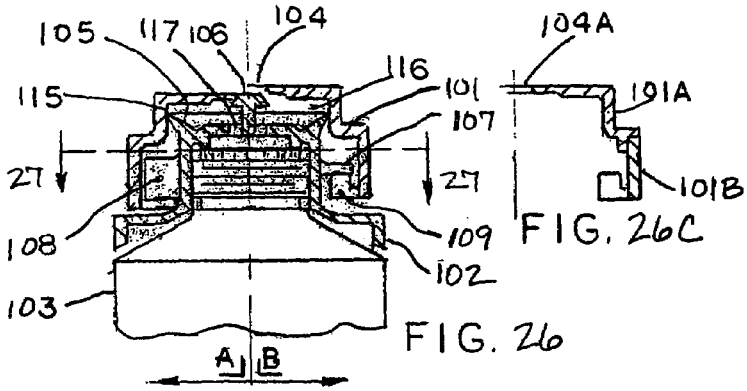
FIG. 26C
FIG. 26
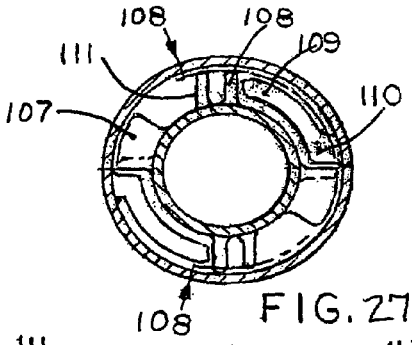
FIG. 27
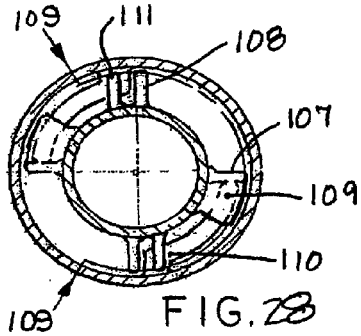
FIG. 28
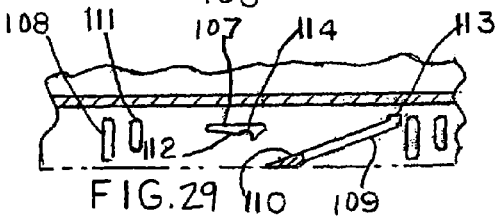
FIG. 29
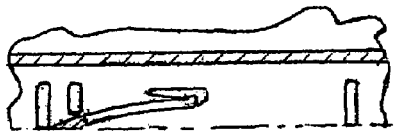
FIG. 31
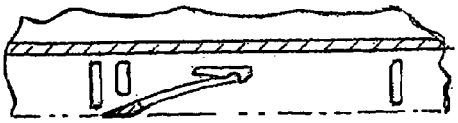
FIG. 30
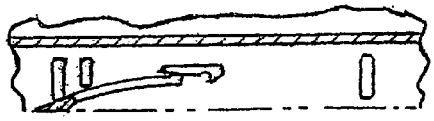
FIG. 32

AUTOMATIC DISPENSING CAP FOR SQUEEZABLE BOTTLE

CROSS REFERENCE TO OTHER APPLICATIONS

This application claims priority of U.S. provisional patent application 60/473,991 filed May 28, 2003 and 60/474,079 filed May 28, 2003, the specifications of which are hereby incorporated by reference in their entirety.

BACKGROUND OF THE INVENTION

The squeezable tube and the squeezable bottle are common containers for products such as creams, lotions, and soaps. The most common devices for opening and closing these squeezable containers are removable caps that are threaded to the container or flip cap dispensing closures. In either case, a two handed effort is required to open the cap before the products can be dispensed and also to close the cap to seal the container. Quite often the cap is not replaced or flipped down, thereby leaving the container unsealed.

To overcome the necessity of a two handed effort to both open and close the containers, a self opening and closing device or automatic dispensing cap is described below.

SUMMARY OF THE INVENTION

To operate the automatic dispensing cap, the consumer squeezes the container until the desired amount of product has been dispensed. When the squeezing ceases the consumer merely wipes off the flush surface of the automatic dispensing cap with a finger or washcloth. In some cases, an automatic dispensing cap, having a side outlet dispensing spout is used, which dispenses the product directly into the consumers hand or in some cases an automatic dispensing cap with a nozzle to dispense a product on a surface can be used.

There are two types of automatic dispensing caps, vented and non-vented. The non-vented automatic dispensing cap is used with tubes that remain collapsed and do not revert back to their original shape after being squeezed. It can operate under severe moisture conditions, such as in a shower, without inhaling or sucking in ambient moisture or other matter that may contaminate or dilute the product remaining in the container. In addition to shower use, an automatic dispensing cap having a floatation collar incorporated for bathtub use, allows the consumer to have one or more floating tubes of soap, body lotion, shampoo, etc. at the tip of their fingers while in the bathtub, whirlpool tub, or hot tub.

The vented automatic dispensing cap is used with squeezable containers or bottles that revert back to their original shape after squeezing. These types of containers require a closure that will permit atmospheric pressure to introduce air into the container to replace the product that was removed during dispensing.

There are two orientations of vented automatic dispensing caps. The first orientation requires that the bottle be stored and/or operated in the inverted position with the cap down, this allows fluid like products to flow to the automatic dispensing cap for dispensing, also referred to herein as class 1 caps. Existing closures that have a self-opening and self-closing feature also have this requirement. The second orientation of vented automatic dispensing cap is an important departure from this requirement. It is designed to dispense the product with the container stored and operated in the upright position with the cap up, also referred to herein as class 2 caps. In some cases the upright, vented automatic dispensing cap can be used in place of a counter top pump type dispenser, especially if it has a side outlet dispensing spout.

At certain times, it is desirable to disable the dispensing mechanism of the automatic dispensing cap. For this purpose the automatic dispensing cap is provided with a disabled or locked position that prevents the product from being dispensed when the container is squeezed.

The non-vented automatic dispensing cap is generally formed of a body, a two diameter piston having a hollow rod and an integral valve, a coil spring and a retainer cap. The body is threadably secured to a squeezable tube and has a hole in which the smaller diameter of the piston operates. The retainer cap is threaded to the body, which forms a cylinder in which the large diameter of the piston operates. The coil spring operates between the lower side of the large diameter of the piston and the body and biases the piston toward the retainer cap, which has a dispensing hole in which the integral piston valve is seated. The portion of the cylinder between the top of the large diameter of the piston and the retainer cap is referred to as the pressure chamber. The portion of the cylinder between the lower side of larger diameter of the piston and the body is vented to atmosphere.

When the tube is squeezed, the product is forced through the hollow rod of the piston into the pressure chamber. The product pressure will cause the piston to compress the spring and move the valve away from the dispensing hole in the retainer cap, thus allowing the product to be dispensed. When the container is released, the product pressure drops and the spring returns the piston and integral valve to the sealing position preventing any air or foreign matter from entering. Since there is no venting of the tube, the tube volume will be reduced by the amount of the product dispensed, this causes the tube to collapse. It will continue to collapse with each dispensing cycle.

The class 1 (inverted), vented automatic dispensing cap is similar to the non-vented automatic dispensing cap described above with the exception of adding venting holes and a shallow venting groove on the pressure side of the large piston face that would port the pressure chamber to the vented area.

In order to maintain pressure in the pressure chamber, a flat donut shaped highly flexible and elastic flapper valve is used. The lower face of flapper valve near the outside diameter is secured to the pressure side of the piston. The lower face of the flapper valve near its inside diameter is seated against and is stretched over a shallow conical shaped portion of the pressure side of the piston, thus sealing the shallow venting groove.

Containers that require venting are made of a resilient material that returns to the original shape or volume prior to squeezing. When the inverted container is squeezed, the product is forced through the hollow rod of the piston into the pressure chamber. Since the flapper valve is stretched over the conical face of the piston thus forming a seal against the piston face, the product cannot enter the vented area under the piston, therefore, the product pressure will cause the piston to compress the spring and move the integral valve away front the dispensing hole in the retainer cap, thus allowing the product to be dispensed.

When the container is released the product pressure drops and the spring returns the piston and valve to the sealing position. As the container tries to return to its original volume, it must make up for the amount of product dispensed. This causes a slight vacuum to occur in the container which in turn will cause atmospheric pressure, present in the vented side of the piston, to enter the venting ports on the face of the large diameter of the piston and unseat the flexible flapper valve, thus allowing air to enter the pressure chamber, flow through the hollow piston rod and into the container, thereby making up the volume lost during dispensing. After the replacement air volume is introduced in the container, the flapper valve reseals the pressure side of the piston.

The class 2 (upright) vented automatic dispensing cap is a variation of the class 1 vented automatic dispensing cap. The class 2 vented automatic dispensing cap moves the flapper valve from the top side of the piston to the container side of the body. The same principle of a highly elastic flat donut shape valve stretched over and sealing against a conical shaped surface applies. The venting in the case brings replacement air directly into the container instead of the pressure chamber. In addition to relocating the flapper valve, a tube is secured to the body and extends to the lower part of the container.

When the container is squeezed, the pressure in the container forces the product through the tube and the hollow rod of the piston into the pressure chamber. The product pressure will cause the piston to compress the spring and move the valve away from the dispensing hole in the retainer cap, thus allowing the product to be dispensed. When the container is released, the product pressure drops and the spring returns the piston and valve to the sealing position. As the container tries to return to its original volume, it must make up for the amount of product dispensed. This causes a slight vacuum to occur in the container. Since the dispensing hole is closed and there is no venting in the pressure chamber, the container will cause atmospheric pressure present in the vented area between the lower side of the piston and the upper face of the body to unseat the flapper valve secured to the container side of the body, thereby allowing replacement air to enter the container directly. Having the air enter the container directly prevents any belching. Belching occurs when air is trapped in the pressure chamber and is expelled during the next dispensing cycle.

To lock out the automatic dispensing feature, the retainer cap is rotated to the locked position. This will move the piston and valve, compressing the spring until the large diameter piston is seated against the body. This will cause the dispensing hole in the retainer cap to be sealed by the valve, and will prevent any product pressure caused by squeezing the container to move the piston and unseat the valve. When the retainer cap is rotated in the opposite direction, a rotation limiter stops the retainer cap at the operating position.

Another group of non-vented automatic dispensing caps, also for use with tubes are formed of two pieces: a body and a cap. The cap is a two diameter cup shaped part, having a dispensing hole, two integral cantilever springs spaced equally and extending from the inside diameter and at the open edge of the walls of the cup. The springs are formed as though they are two partial inside diameter flanges approximately ninety degrees in length and are disconnected from the walls of the cup for most of their length to permit the flanges to flex when a force is applied to the disconnected ends. The springs are molded to be at an angle to the open face of the cup.

The body is threadably secured to a squeezable tube and formed to have a lip seal at the upper end that engages inside the smaller diameter of the cap. The body has an integral valve that engages and seals the dispensing hole in the cap. A port in the end of the body permits the product in the tube to flow into a pressure chamber formed by the inside of the cap and the seal of the body.

Extending from the body are two horizontal lugs spaced equally and two primary vertical lugs spaced equally and at ninety degrees out of phase with the horizontal lugs. Two secondary vertical lugs are adjacent to the primary vertical lugs. The body also has a flange used to tighten it onto the thread of the tube. The horizontal lugs have an angled end, a stepped and notched portion followed by an angled surface. The primary vertical lugs have a rectangular outer surface. The secondary vertical lugs have a rectangular outer surface and are somewhat shorter than the primary vertical lugs.

When the cap is initially assembled to the body, it is first aligned so the spring portion falls between the vertical and horizontal lugs of the body, then it is advanced onto the body and rotated until the attached ends of the cantilever springs on the cap engage the bottom of the primary vertical lugs of the body. The automatic dispensing cap will then be in the locked or disabled position with the valve of the body sealing the dispensing hole in the cap. The rotation will also cause the detached ends of the cantilever springs to be deflected becoming engaged with the horizontal lugs. The ends of the cantilever springs will be in contact with the angled portion of the horizontal lugs, which provide some resistance to rotating the cap from the locked position.

To dispense the product in the tube, the consumer sets the automatic dispensing cap to the automatic dispensing position by reversing the rotation of the cap until it reaches a positive stop. At this point the cantilever springs will still be engaged with the horizontal lugs and limited from further rotation by the ends of the cantilever springs being against the stepped portion of the horizontal lugs. Slightly raised bumps on the ends of the cantilever springs are seated in the notches of the horizontal lugs to prevent accidental rotation of the cap from the automatic dispensing position. With the cap in the automatic dispensing position the force from the cantilever springs of the cap on the horizontal lugs of the body will provide sufficient force on the dispensing hole in the cap on the valve of the body to seal the dispensing hole in the cap. The secondary vertical lugs will contact the attached ends of the cantilever springs to prevent any excess strain that might cause the springs to fail if an accidental separating force is applied to the cap when in the automatic dispensing position.

When the tube is squeezed with the automatic dispensing cap in the automatic dispensing position, the product is forced through the port in the body to the pressure chamber. The product pressure will cause the cap to move away from the body, which will deflect the cantilever springs and move the dispensing hole away from the valve thus allowing the product to be dispensed.

When the tube is released, the product pressure drops and the cantilever springs return the cap so that the dispensing hole in the cap is sealed by the valve of the body. Since a positive pressure in the pressure chamber exists, both before the cap moves during dispensing and for a short time after the cap is sealed, when the tube is released, there is no opportunity for air, foreign matter or water to enter the automatic dispensing cap during dispensing. This makes it an ideal device to use in the shower or even in the bathtub. It can operate under water with no product contamination. Since there is no venting of the tube, the tube volume will be reduced by the amount of product dispensed. This causes the tube to collapse. It will continue to collapse with each dispensing cycle.

The class 1, or inverted, vented automatic dispensing cap is similar to the non-vented automatic dispensing cap described above with the exception of adding a side entry venting port connected to a groove on the bottle side of the body, just above the bottle neck. The port allows replacement air to enter directly into the bottle.

In order to pressurize the bottle and pressure chamber when the bottle is squeezed, a flat donut shaped highly flexible and elastic flapper valve is used to seal the venting groove. The outside diameter of the flapper valve is retained by and sealed against the bottle side of the body by a combination valve retainer and bottle seal. The upper face of the flapper valve near its inside diameter is seated against and is stretched over a shallow conical shaped portion of the container side of the body, thus sealing the shallow groove.

Bottles that require venting are made of a resilient material that returns to the original shape or volume prior to squeezing. When the inverted bottle is squeezed, the product is forced through the port of the body and into the pressure chamber. Since the flapper valve is sealed against the body, the product cannot enter the venting groove of the body, therefore, the product pressure will cause the cap to move way front the body which will deflect the cantilever springs and move the dispensing hole away from the valve, thus allowing the product to be dispensed.

When the bottle is released, the product pressure drops and the cantilever springs return the cap to its original position so the dispensing hole in the cap is sealed by the valve of the body. As the bottle attempts to return to its original volume it must make up for the amount of product dispensed. This causes a slight vacuum to occur in the bottle. Since the dispensing hole is sealed, and there is no venting in the pressure chamber, the vacuum in the bottle will cause atmospheric pressure present on the vented side of the body to enter the venting port and groove and unseat the flapper valve secured to the bottle side of the body, thereby allowing replacement air to enter the container directly. After the replacement air is introduced in the bottle, the flapper valve reseals the pressure side of the body.

The class 2 (upright) vented automatic dispensing cap is identical to the class 1 (inverted) vented automatic dispensing cap with the exception of adding a pressure tube that is secured into the port on the bottle side of the body and extends to the lower part of the bottle. When the upright bottle is squeezed, the pressure in the bottle forces the product through the tube and the port in the body and into the pressure chamber. All functions relating to the dispensing cycle and the introduction of replacement air back into the bottle are the same as the class 1, vented automatic dispensing cap. Belching is prevented because the replacement air must come directly into the bottle as previously described and cannot enter the pressure chamber because the tube isolates the pressure chamber from the air in the bottle.

Several variations of the above are described in the following text and drawings. They include a nozzle type retainer cap for applying product to a specific area, a non-vented automatic dispensing cap having a flotation collar that causes the tube to float when used in a bath tub for such products as soap, shampoo and body lotion, and a side outlet dispensing spout for use when the automatic dispensing cap can be operated with the container in the vertical or near vertical position such as the non-vented automatic dispensing cap or the class 2, vented automatic dispensing cap.

BRIEF DESCRIPTION OF DRAWINGS

FIG. 26 is section shown through a removable, non-vented, two-piece automatic dispensing cap. Side A shows the automatic dispensing cap in the sealed position, side B shows the automatic dispensing cap open during the dispensing cycle.

FIG. 26C shows the automatic dispensing cap having an alternate design to provide the simpler mold requirements and less costly to change dispensing hole size.

FIG. 27 is a section taken along line 27—27 of FIG. 26 showing the relationship of the two parts when they are initially assembled.

FIG. 28 is a section taken along line 27—27 of FIG. 26 showing the relationship of the two parts when they have been rotated to the automatic dispensing position.

FIG. 29 is a roll-out view taken along circular line 29—29 of FIG. 28 showing the relationship of the two parts when they are initially assembled.

FIG. 30 is a roll-out view taken along circular line 30—30 of FIG. 38 showing the relationship of the two parts when the automatic dispensing cap is in the automatic dispensing position and ready for a user to dispense product, see FIG. 26B.

FIG. 31 is a roll-out view taken along circular line 30—30 of FIG. 28 showing the relationship of the two parts when they are in the automatic dispensing position while product is being dispensed.

FIG. 32 is a roll-out view taken along circular line 30—30 of FIG. 28 showing the relationship of the two parts when automatic dispensing cap is sealed and rotated to the locked position to prevent accidental dispensing of product.

DETAILED DESCRIPTION AND OPERATION OF THE INVENTION

Figure 2:
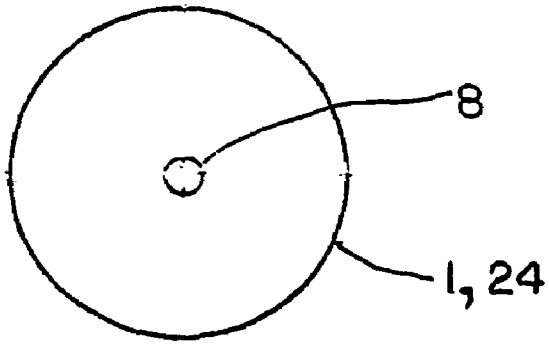
FIG. 2 is a top view of the automatic dispensing cap shown in FIG. 1.
Figure 3:
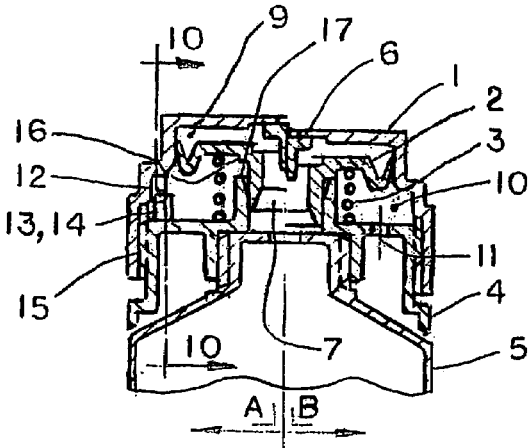
FIG. 3 is a section through a removable non-vented automatic dispensing cap using a coil spring as a piston return device. Side A shows the automatic dispensing cap in the operating position and side B shows the automatic dispensing cap in the locked position.

FIG. 3 shows a removable type of a non-vented automatic dispensing cap formed of body 4 that is threaded to conventional tube 5. Threadably secured to body 4 is retainer cap 1 having product-dispensing hole 8 shown in FIG. 2, which operates in a two chamber cylinder formed by body 4 and retainer cap 1. The large diameter of piston 2 has a sealing lip that contacts the inner surface of retainer cap 1. The hollow rod of piston 2 has a sealing lip that contacts the inner surface of body 4. Piston 2 has integral valve 6 that engages and seals product-dispensing hole 8. Coil spring 3 operates between piston 2 and body 4. Chamber 10 is vented to the atmosphere by venting hole 11.

When tube 5 is squeezed, a pressure develops causing the product in tube 5 to flow through port 7 of piston 2 into pressure chamber 9 formed by piston 2 and retainer cap 1. As the pressure increases on piston 2 in chamber 9, the preset biasing force of coil spring 3 is exceeded, causing piston 2 and valve 6 to move away from the position that seals dispensing hole 8, thus allowing the product to flow through dispensing hole 8 until the squeezing action on tube 5 ceases.

When the squeezing action ceases, the pressure will drop and the force from coil spring 3 will cause piston 2 and valve 6 to return to the sealing position. As this occurs, any product at dispensing hole 8 will be expelled as valve 6 seals hole 8, therefore preventing any opportunity for ambient material or air to enter hole 8. After the squeezing action ceases, the consumer merely wipes the product from the flat surface of retainer cap 1 and the nearly flush surface of valve 6.

FIG. 3B shows the automatic dispensing cap in the locked position. To lock the automatic dispensing cap, retainer cap 1 is generally rotated in a clockwise direction, advancing on threads 15 until retainer cap 1, being engaged with valve 6 at dispensing hole 8, forces piston shoulder 16 against face 17 of body 4. When this occurs, the rotation of retainer cap 1 is stopped and dispensing hole 8 is sealed by valve 6.

Figure 10:
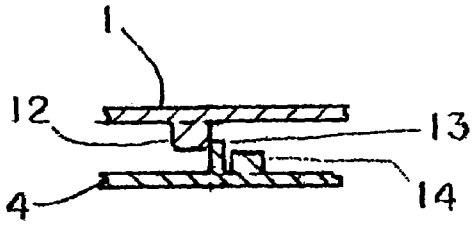
FIG. 10 is a section taken along line 10—10 of FIG. 3 showing the rotation limiter that stops the retainer cap at the operating position.

To return the automatic dispensing cap to the operating position, as shown in FIG. 3A, retainer cap 1 is rotated in the opposite direction until rotation stop 12, shown in FIG. 10, engages stop lug 13. Deflection of stop lug 13 is limited by lug 14. The configuration of lugs 13 and 14 allows rotation stop 12 to deflect stop lug 13 sufficiently for rotation stop 12 to pass over lug 14, during the assembly of retainer cap 1.

Figure 4:
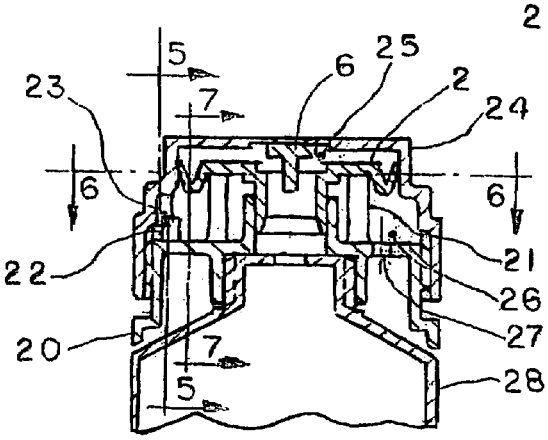
FIG. 4 is a section through a removable non-vented automatic dispensing cap using multiple leaf springs, which are integral with the body, to provide a piston return means.
Figure 7:
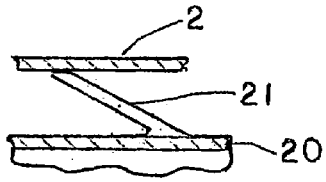
FIG. 7 is a section taken along line 7—7 of FIG. 4 showing a side view of the leaf spring integral with the body.

FIG. 4 shows a removable type of a non-vented automatic dispensing cap formed of body 20 that is threaded to conventional tube 28. Threadably secured to body 20 is retainer cap 24 having product-dispensing hole 8 shown in FIG. 2. Piston 2 operates in a two chamber cylinder formed by body 20 and retainer cap 24. The large diameter of piston 2 has a sealing lip that contacts the inner surface of retainer cap 24. The hollow rod of piston 2 has a sealing lip that contacts the inner surface of body 20. Piston 2 has integral valve 6 that engages and seals product dispensing hole 8. Leaf springs 21, seen in FIG. 7, which are integral with body 20, operate between piston 2 and body 20. Chamber 26 is vented to atmosphere by venting hole 27.

The operation of the automatic dispensing cap 4 is identical to the operation of the automatic dispensing cap in FIG. 3.

Figure 5:
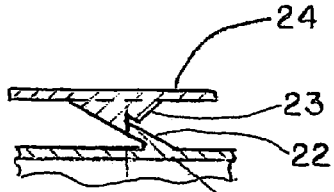
FIG. 5 is a section taken along line 5—5 of FIG. 4 showing the rotation limiter that stops the retainer cap at the operating position.
Figure 6:
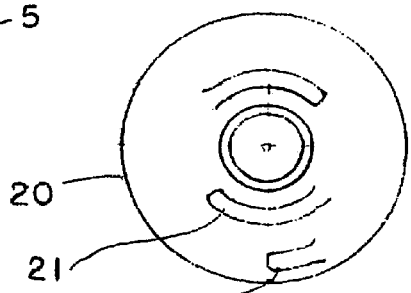
FIG. 6 is a view taken along line 6—6 of FIG. 4 showing a top view of the multiple leaf springs that are integral with the body.

FIG. 4 shows the automatic dispensing cap in the operating position. The locking feature works the same as the automatic dispensing cap in FIG. 3. However, when retainer cap 24 is rotated to the operating position, rotation stop 23, seen in FIG. 5, engages stop lug 22, thereby preventing any further rotation. The configuration of stop lug 22 allows it to be deflected by rotation stop 23 during the assembly of retainer cap 24 to body 20.

Figure 8:
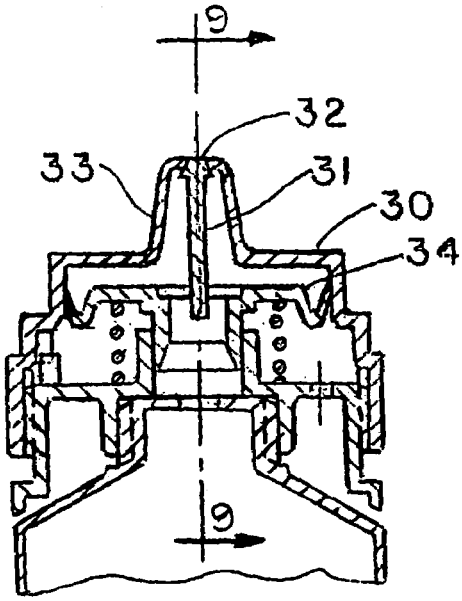
FIG. 8 is a section through a removable non-vented automatic dispensing cap having a nozzle type retainer cap.
Figure 9:
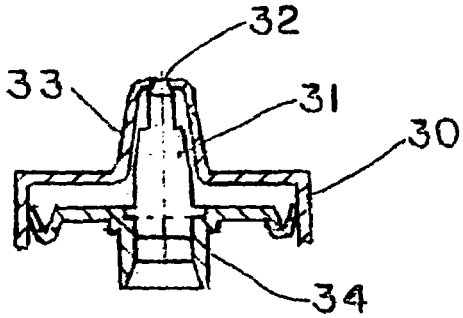
FIG. 9 is a section taken along line 9—9 of FIG. 8 showing the configuration of the piston and integral shut off valve.

The automatic dispensing cap in FIG. 8 has a retainer cap 30 with an extended nozzle 33. Piston 34 has valve extension 31 and integral valve 32. Valve 32 is configured to seat in the tapered dispensing hole of nozzle 33.

The operation of the automatic dispensing cap in FIG. 8 is identical to the operation of the automatic dispensing cap in FIG. 3. The locking feature also is the same.

Figure 11:
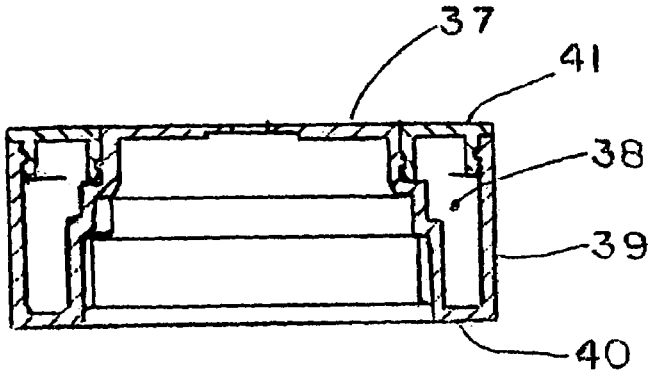
FIG. 11 is a section through a retainer cap having a floatation collar for use with a non-vented automatic dispensing cap. This arrangement allows the tube containing the product to float.

FIG. 11 shows a variation of a retainer cap for a non-vented automatic dispensing cap modified to provide a floatation ring. Retainer cap 37 is provided with an outer air chamber 38 formed by integral circular base wall 40, and integral outer ring 39. Sealing cap 41 is secured to retainer cap 37 and outer ring 39, thereby forming air chamber 38 to provide the desired floatation.

Figure 13:
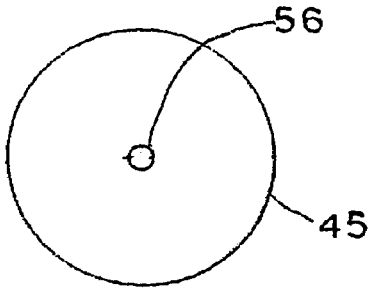
FIG. 13 is a top view of the vented automatic dispensing cap shown in FIG. 12.
Figure 15:
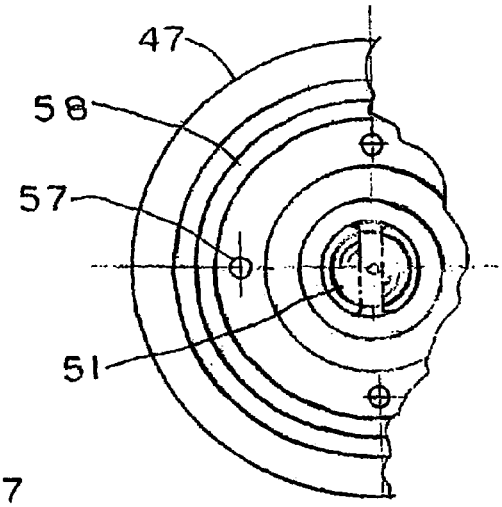
FIG. 15 is a top view of the piston shown in FIG. 14 without the flapper valve.
Figure 12:
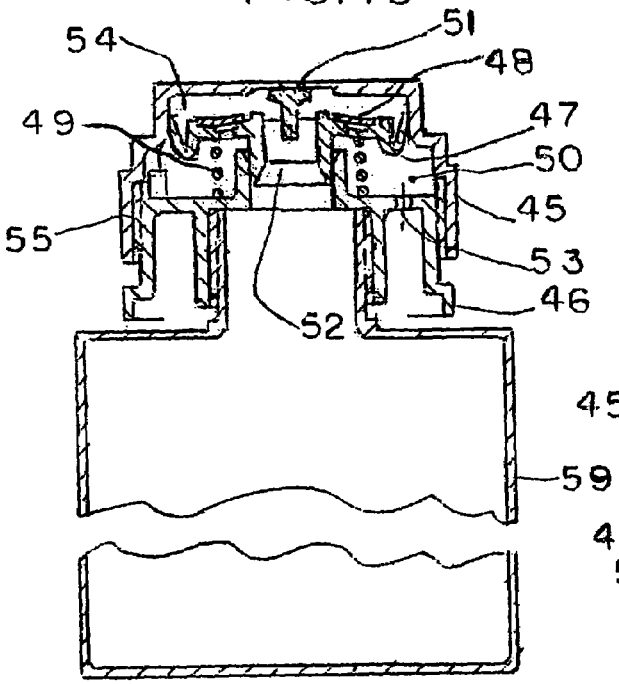
FIG. 12 is a section through a class 1 (inverted), vented automatic dispensing cap.

FIG. 12 shows a class 1, removable type of vented automatic dispensing cap formed of body 46 that is threaded to squeezable bottle 59. Threadably secured to body 46 is retainer cap 45 having product-dispensing hole 56 shown in FIG. 13. Piston 47 operates in a two chamber cylinder formed by body 46 and retainer cap 45. The large diameter of piston 47 has a sealing lip that contacts the inner surface of retainer cap 45. The hollow rod of piston 47 has a sealing lip that contacts the inner surface of body 46. Piston 47 has integral valve 51 that engages and seals product-dispensing hole 56. Coil spring 49 operates between piston 47 and body 46. Chamber 50 is vented to atmosphere by vent hole 53. Piston 47 has shallow venting groove 58 and venting hole 57 shown in enlarged section in FIG. 14. The lower face near the outside diameter of flapper valve 48 is secured to piston 47. The lower face near the inside diameter of flapper valve 48 is stretched over shallow conical surface 60 of piston 47, thereby providing a seal between pressure chamber 54 and vented chamber 50 when the pressure in both chambers are nearly equal as shown in FIG. 12.

Generally the class 1 (inverted), vented automatic dispensing cap is used with a squeezable bottle that is stored in the inverted position. When the inverted bottle 59 is squeezed, a pressure develops causing the product in bottle 59 to flow through port 52 of piston 47 into pressure chamber 54 formed by piston 47 and retainer cap 45. As the pressure increases on piston 47 in chamber 54, the preset biasing force of coil spring 49 is exceeded, causing piston 47 and valve 51 to move away from the position that seals dispensing hole 56, thus allowing the product to flow through dispensing hole 56 until the squeezing action on bottle 59 ceases.

Figure 14:
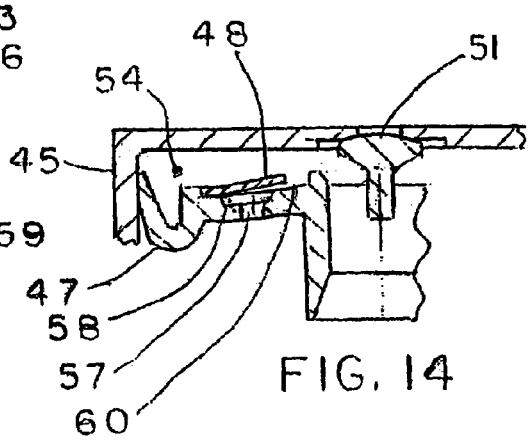
FIG. 14 is an enlarged, partial section of the piston and flapper valve shown in FIG. 12 with a flapper valve in the venting position.

When the squeezing action ceases on bottle 59, the pressure will drop and the force from coil spring 49 will cause piston 47 and valve 51 to return to a position that seals hole 56. After the squeezing action ceases, the consumer merely wipes the product from the flat surface of retainer cap 48 and the nearly flush surface of valve 51. Since the vented automatic dispensing cap is generally used with a bottle that is stored with the cap down, a shallow concave surface for retainer cap 45 may benefit the stability for storing and provide a slight clearance at dispensing hole 56. As bottle 59 tries to return to its original volume it must make up for the amount of product dispensed. This causes a vacuum to occur in container 59 and in chamber 54, which in turn will cause atmospheric pressure present in the vented side of piston 47 by means of vent hole 53 in body 46 to enter venting port 57 and shallow venting groove 58 of piston 47 and unseat flapper valve 48 as shown in FIG. 14. This allows air to enter container 59 by way of chamber 54 and make up the volume lost during dispensing. Since it requires a pressure differential to unseat flapper valve 48, flapper valve 48 acts as a check valve, therefore there can be no chance of reverse flow or product leakage through flapper valve 48. After the replacement air volume is introduced in container 59, flapper valve 48 reseals the pressure side of piston 47.

Figure 17:
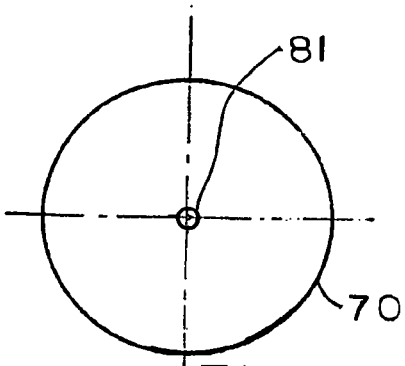
FIG. 17 is a top view of the automatic dispensing cap shown in FIG. 16.
Figure 16:
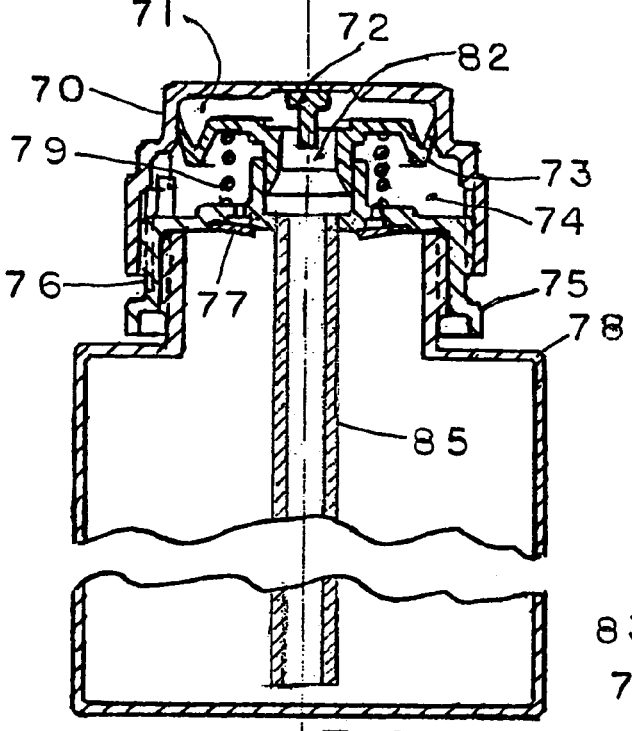
FIG. 16 is a section through a class 2 (upright), vented automatic dispensing cap.
Figure 19:
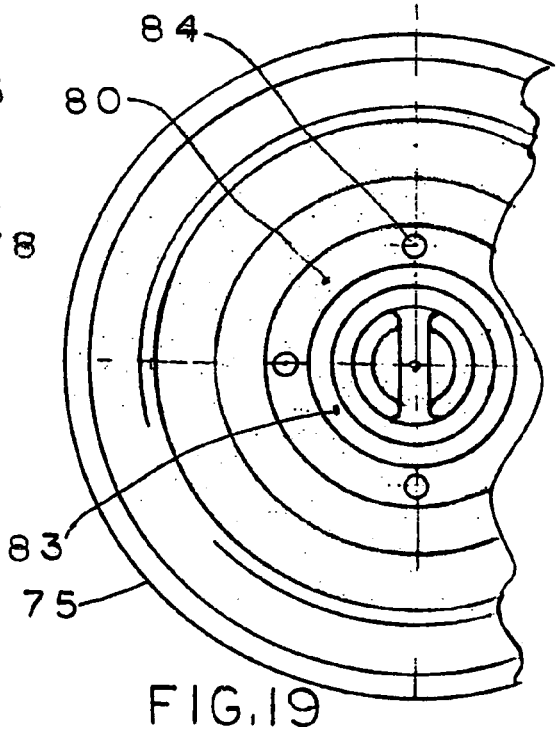
FIG. 19 is a bottom view of the body shown in FIG. 18 without the flapper valve.

FIG. 16 shows a class 2 (upright), removable type of vented automatic dispensing cap formed of body 75 that is attached to squeezable bottle 78. Threadably secured to body 75 is retainer cap 70 having product-dispensing hole 81 shown in FIG. 17. Piston 73 operates in a two chamber cylinder formed by body 75 and retainer cap 70. The large diameter of piston 73 has a sealing lip that contacts the inner surface of retainer cap 70. The hollow rod of piston 73 has a sealing lip that contacts the inner surface of body 75. Piston 73 has integral valve 72 that engages and seals product-dispensing hole 81. Coil spring 79 operates between piston 73 and body 75. Chamber 74 is vented to atmosphere by vent slot 76 of body 75. Body 75 has shallow groove 80 and venting hole 84 shown in enlarged section in FIG. 18. The upper face near the outside diameter of flapper valve 77 is secured to the lower face of body 75. The upper face near the inside diameter of flapper valve 77 is stretched over shallow conical surface 83 of body 75, thereby providing a seal between container 78 and vented chamber 74 when the pressure in container 78 and chamber 74 are nearly equal, as shown in FIG. 16. Tube 85 is secured to body 75 and extends to the lower portion of bottle 78.

The class 2 (upright), vented automatic dispensing cap is used with a squeezable bottle that is stored in the upright position. When the upright bottle 78 is squeezed, a pressure develops causing the product in bottle 78 to flow through tube 85 and port 82 of piston 73 into pressure chamber 71 formed by piston 73 and retainer cap 70. As the pressure increases on piston 73 in chamber 71, the preset biasing force of coil spring 79 is exceeded, causing piston 73 and valve 72 to move away from the position that seals dispensing hole 81, thus allowing the product to flow through dispensing hole 81 until the squeezing action on bottle 78 ceases.

When the squeezing action ceases on bottle 78, the pressure will drop and the force from coil spring 79 will cause piston 73 and valve 72 to return to a position that seals hole 81. After the squeezing ceases, the consumer merely wipes the product from the flat surface of retainer cap 70 and nearly flush surface of valve 72.

Figure 18:
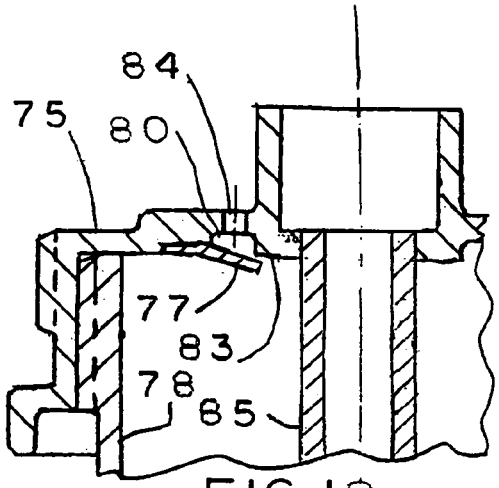
FIG. 18 is an enlarged partial section of the body and flapper valve shown in FIG. 16 with the flapper valve in the venting position.

As bottle 78 tries to return to its original volume, it must make up for the amount of product dispensed. This causes a vacuum to occur in container 78, which in turn will cause atmospheric pressure present in chamber 74 to enter venting hole 84 and shallow venting groove 80 of body 75 and unseat flapper valve 77, as shown in FIG. 18. This allows air to enter container 78 and replace with air the product volume lost during dispensing. Since it requires a pressure differential to unseat flapper valve 77, flapper valve 77 acts as a check valve. Therefore, there can be no chance of reverse flow or product leakage through flapper valve 77. Alter the replacement air volume is introduced in container 78, flapper valve 77 reseals the pressure side of body 75.

Figure 21:
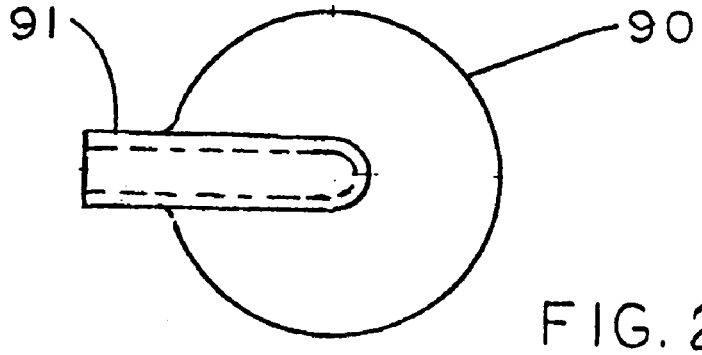
FIG. 21 is a top view of the automatic dispensing cap shown in FIG. 20.
Figure 20:
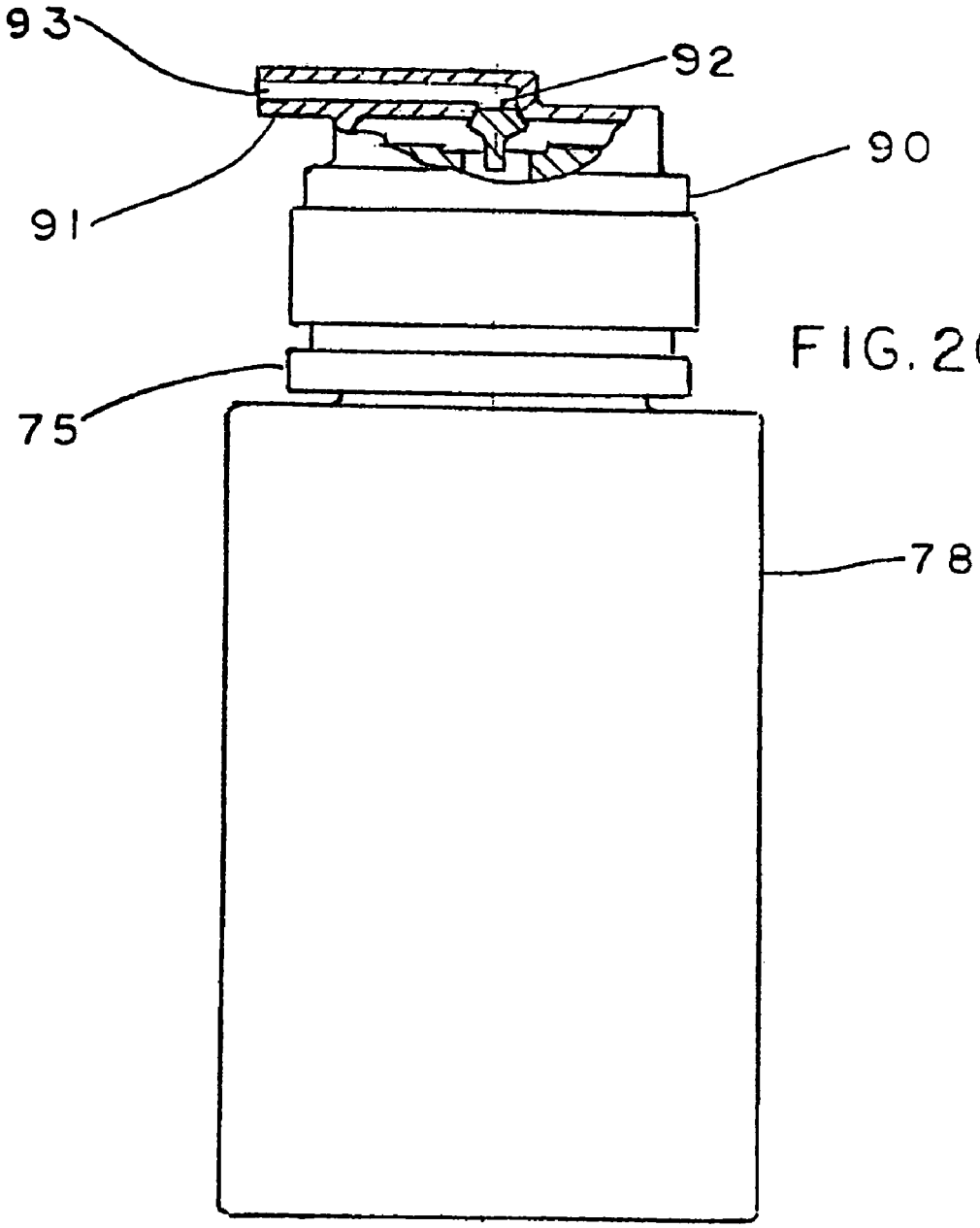
FIG. 20 is a view of a class 2, vented automatic dispensing cap having a side outlet dispenser spout.

The class 2 (upright), vented automatic dispensing cap shown in FIGS. 20 and 21 has retainer cap 90 with dispensing hole 92 leading through outlet spout 91 to port 93.

When the upright bottle 78 is squeezed, the product will flow through dispensing hole 92 as described previously for class 2 (upright), vented automatic dispensing cap shown in FIG. 16, from dispensing hole 92, the product will flow through port 93 and exit spout 91. During the squeezing action, the product is dispensed into the palm of the consumer's hand. For very low viscosity products a slight angle port may be used to prevent drippage.

Figure 1:
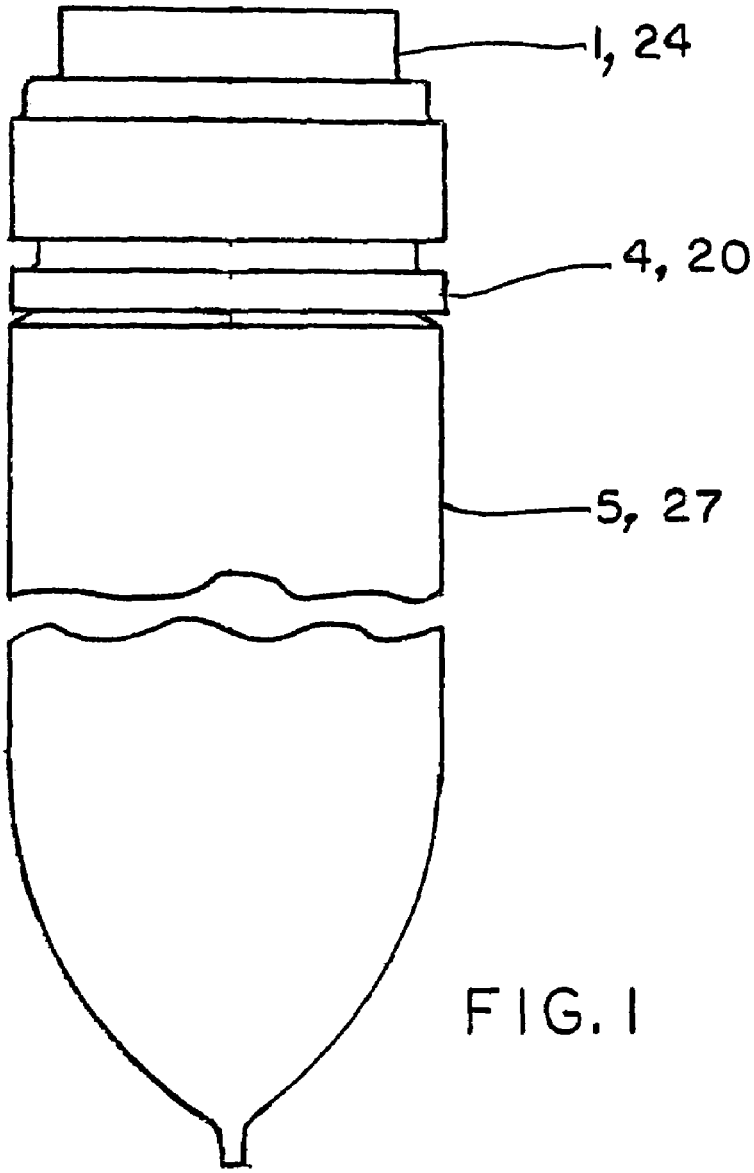
FIG. 1 is an external view of a conventional tube with a removable automatic dispensing cap.

A side outlet retainer similar to the one shown in FIG. 20 can be used with the squeezable tube shown in FIG. 1. For certain applications, this may be preferred by the consumer.

FIGS. 12 and 16 show the vented automatic dispensing cap in the operating position. A locking feature similar to the one for the non-vented automatic dispensing cap shown in FIG. 3 can be used with the vented automatic dispensing cap.

Figure 23:
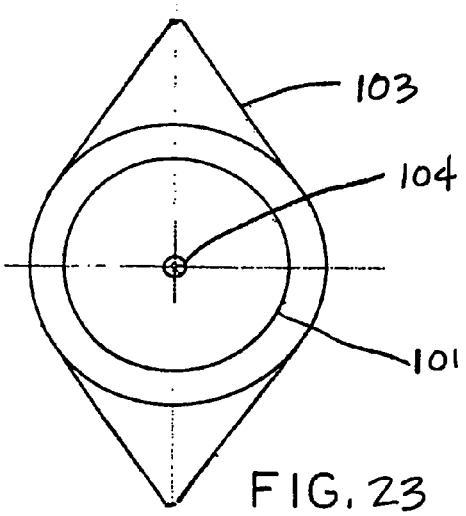
FIG. 23 is a top view of the automatic dispensing cap and tube shown in FIG. 22.
Figure 25:
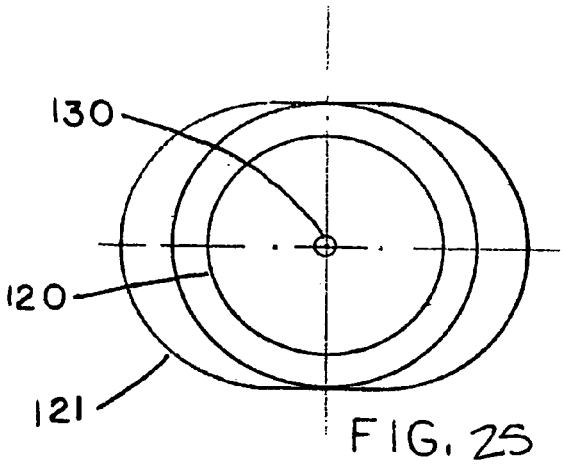
FIG. 25 is a top view of the automatic dispensing cap and bottle shown in FIG. 24.
Figure 22:
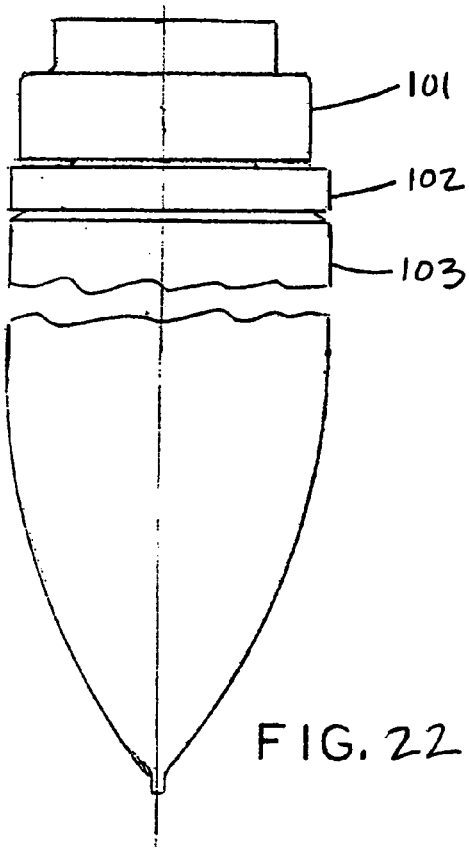
FIG. 22 is an external view of a conventional tube with a removable automatic dispensing cap.
Figure 24:
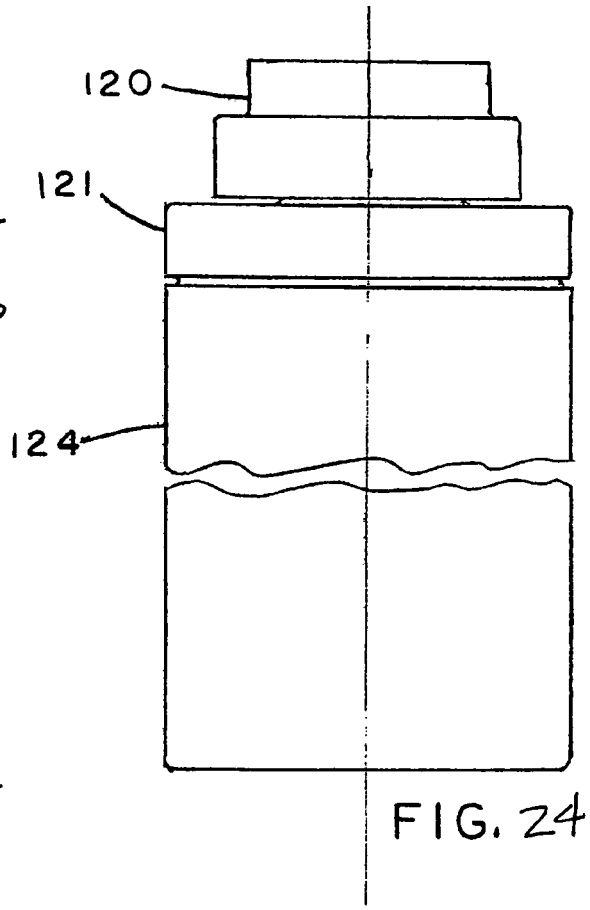
FIG. 24 is an external view of a squeezable bottle with a vented automatic dispensing cap.

FIGS. 22 and 23 show another automatic dispensing cap on a conventional tube 103. FIGS. 24 and 25 show an automatic dispensing cap on a resilient bottle 124.

FIG. 26 shows a removable non-vented automatic dispensing cap including of body 102 that is threaded to squeezable tube 103. Body 102 has lip seal 105, port 117 and valve 106. In addition, body 102 has two horizontal lugs 107, two primary vertical lugs 108 and two secondary vertical lugs 111 shown in FIG. 27. Operating with body 102 is cap 101 including of dispensing hole 104, two cantilever springs 109 having knob 113 that are attached to inside of cap 101 at area 110. When assembled, diameter 115 of cap 101 engages lip seal 105 of body 102 forming pressure chamber 116.

After cap 101 is assembled to body 102 and rotated to the locked position of FIG. 32, the lower surfaces of primary vertical lugs 108 are engaged with area 110 of springs 109 forcing dispensing hole 104 of cap 101 against valve 106 of body 102, thereby sealing the automatic dispensing cap for storage. This initial rotation also causes cantilever springs 109 to be deflected by horizontal lugs 107 and for knobs 113 of springs 109 to engage lugs 107 at angled surfaces 112.

To set the automatic dispensing cap to the automatic dispensing positioning, FIG. 30, the rotation of cap 101 is reversed to a positive stop where knob 113 of springs 109 will then be engaged in notch 114 at stepped portion of lug 107. In this position, the cantilever spring 109 develops a biasing force on cap 101, which causes dispensing hole 104 to engage valve 6 to effectively seal the automatic dispensing cap.

The engagement of knob 113 in notch 114 provides a detent to prevent cap 101 from accidentally being rotated from the automatic dispensing position. With the automatic dispensing cap in the auto position, secondary vertical lugs 111 will limit the vertical travel of cap 101 contacting area 110 of cantilever spring 109 if an accidental separating force is applied to cap 101.

When tube 103 is squeezed, while the automatic dispensing cap is in the automatic dispensing position, a pressure develops causing the product in tube 103 to flow through port 117 into pressure chamber 116. As the pressure increases on cap 101 in pressure chamber 116, the biasing force of cantilever springs 109 is exceeded, causing cap 101 to move away from the position that seals dispensing hole 104 with valve 106, FIG. 26B, thus allowing the product to flow through dispensing hole 104 until the squeezing action on tube 103 ceases.

When the squeezing ceases, the pressure will drop and the force from cantilever springs 109 will cause valve 106 to return into dispensing hole 104 of cap 101. As this occurs, any product at dispensing hole 104 will be expelled as valve 106 seals dispensing hole 104, therefore, preventing any opportunity for ambient material or air to enter hole 104. After squeezing action ceases, the consumer merely wipes the product from the flat surface of cap 101 and the flush surface of valve 106.

FIG. 26C shows cap 101 being formed of cup 101A and spring ring 101B. These separate parts may be produced with less costly molds. Multiple cups 101A having various size dispensing holes 104A may be matched to a common spring ring 118 for further cost consideration. Effectively, cup 101A and spring ring 101B become one part, i.e. cap when they are pressed together. Alternately, the manufacturer may consider one piece cap 101, FIG. 26 more efficient because fewer parts need to be handled.

Figure 33:
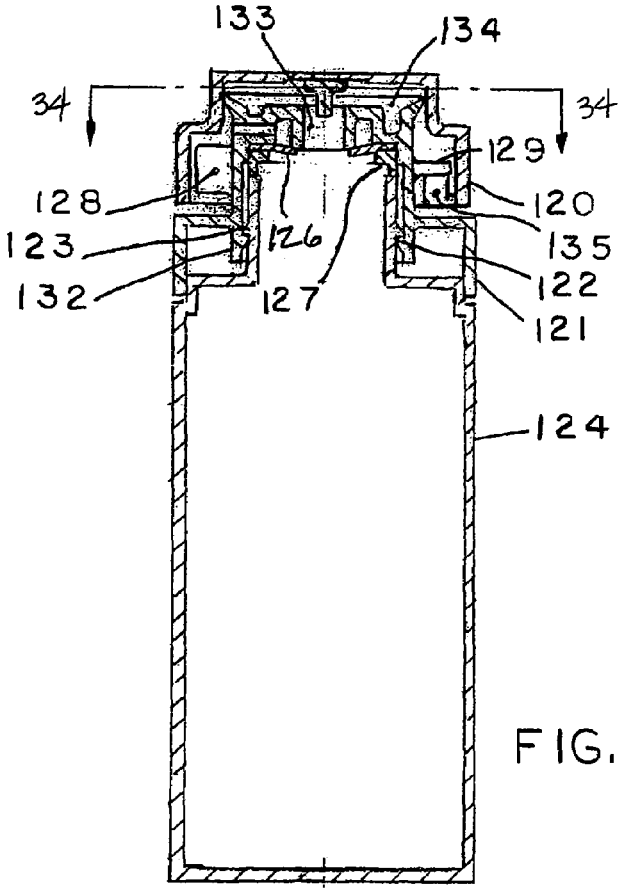
FIG. 33 is a section through an inverted, vented automatic dispensing cap secured to a squeezable bottle.

FIG. 33 shows a class 1 (inverted) vented automatic dispensing cap secured to squeezable bottle 124 and formed of body 121 and cap 120. Cap 120 is configured much like cap 101 shown in FIG. 26 and in some cases can be used interchangeably. Body 121 has many of the elements of body 102 shown in FIG. 26 such as the primary and secondary vertical lugs shown as item 128 and horizontal lug 129. Referring to enlarged section FIG. 35, body 121 has venting hole 125 that connect to venting groove 131. Highly flexible flapper valve 126 is secured to body 127 by retainer-seal 126 that is pressed into body 121 and engages the neck face of bottle 124. During installation, flapper valve 126 is stretched over conical face 128 of body 121 effectively sealing venting groove 131. Again referring to FIG. 33, a tapered ring 123 of bottle 124 is shown engaging and securing taper ring 122, of body 121 such that when body 121 is pressed onto the neck of bottle 124, the taper rings will deflect sufficiently to cause the engagement indicated. If required, slots in appropriate portions around hub 132 of body 121 could be added to allow easier assembly of body 121 to bottle 124. It should be noted that the above is one of several means of securing the vented automatic dispensing cap to a squeezable bottle.

It should also be noted that the elements and function shown in FIGS. 27, 28, 29, 30, 31, and 32 and described in previous text apply to the vented automatic dispensing cap.

Generally the Class 1 vented automatic dispensing cap is used with a squeezable bottle that is stored in the inverted position. When the inverted bottle 124 with the automatic dispensing cap in the automatic dispensing position (FIG. 30) is squeezed, a pressure develops causing the product in bottle 124 to flow through port 133 of body 121 into pressure chamber 134 formed by lip seal 129 and inside diameter of cap 120. As pressure increases on cap 120 in pressure chamber 134, the preset biasing force of cantilever springs 135 is exceeded causing cap 120 to move away from the position that seals dispensing hole 130 of cap 120 with valve 128 of body 121, thus allowing the product to flow through dispensing hole 130 until the squeezing action on bottle 124 ceases.

When the squeezing action ceases, the pressure drops and the force from cantilever springs 135 will cause cap 120 to return dispensing hole 130 to seal against valve 128. As this occurs, any product at dispensing hole 130 will be expelled as valve 128 seals dispensing hole 130. At this point, the consumer merely wipes off the product from the flat surface of cap 120.

Figure 35:
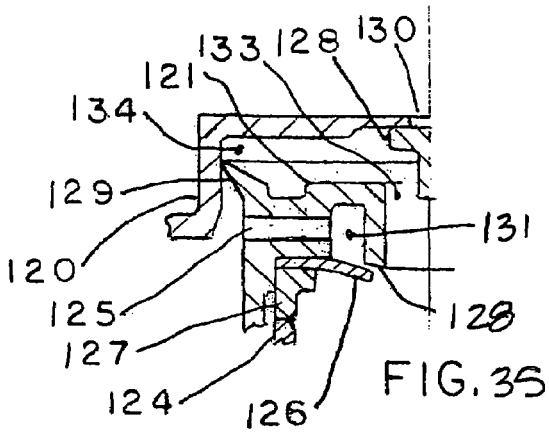
FIG. 35 is an enlarged section taken along line 35—35 of FIG. 34.

As bottle 124 tries to return to its original volume to make up for the amount of product dispensed, a vacuum occurs in container 124, which in turn causes atmospheric pressure to enter venting port 125 and venting groove 131 of body 121 and unseat flapper valve 126 as shown in FIG. 35. This allows replacement air to enter container 124 and make up the product volume lost during dispensing. Since it requires a pressure differential to unseat flapper valve 126, flapper valve 126 acts as a check valve, therefore there can be no chance of reverse flow of product leakage through flapper valve 126. After the make up volume is introduced in container 124, flapper valve 126 reseals the pressure side of body 121.

Figure 34:
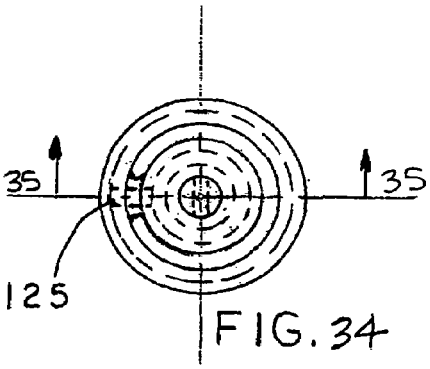
FIG. 34 is a view taken along line 34—34 of FIG. 33.
Figure 36:
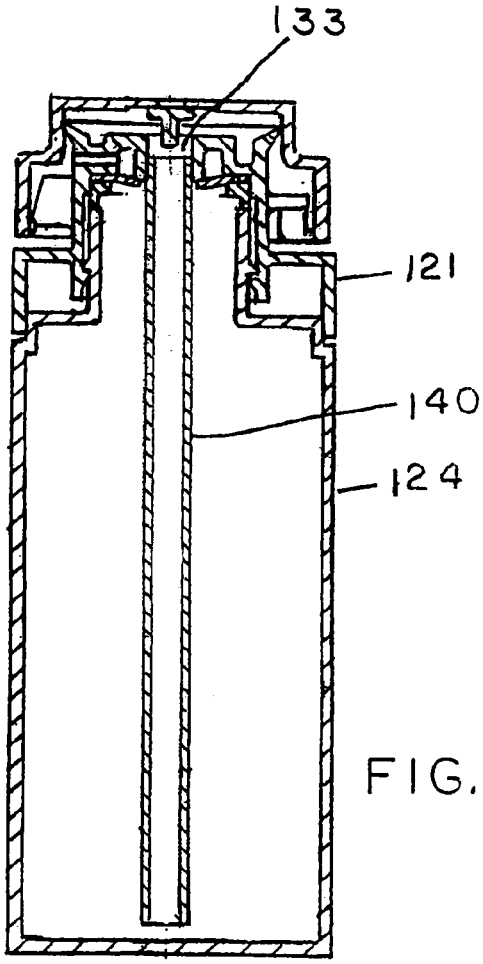
FIG. 36 is a section through an upright, vented automatic dispensing cap secured to a squeezable bottle.

The class 2 (upright) vented automatic dispensing cap is shown in FIG. 36. It is identical to the class 1 automatic dispensing cap shown in FIGS. 33, 34, 35 with the exception of adding pressure tube 140. Pressure tube 140 is secured into port 133 of body 121 and extends to the lower part of the bottle.

When upright bottle 124 is squeezed with the automatic dispensing cap in the automatic dispensing position, the pressure in bottle 124 forces the product through tube 140 and port 133 into pressure chamber 134. All functions relating to the dispensing cycle and the introduction of replacement air back into bottle 124 are the same as the class 1 automatic dispensing cap described above and shown in FIG. 33.

Figure 37:
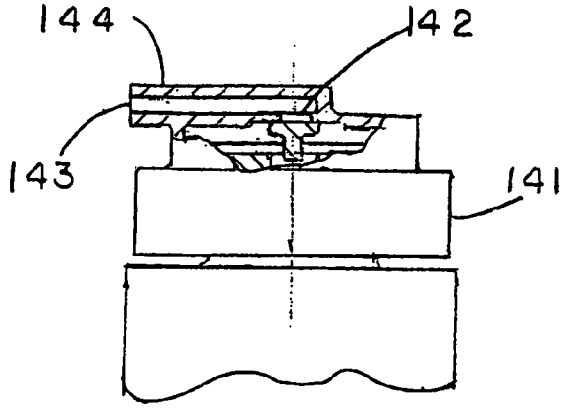
FIG. 37 is a view of an upright, vented automatic dispensing cap having a side outlet dispensing spout.
Figure 38:
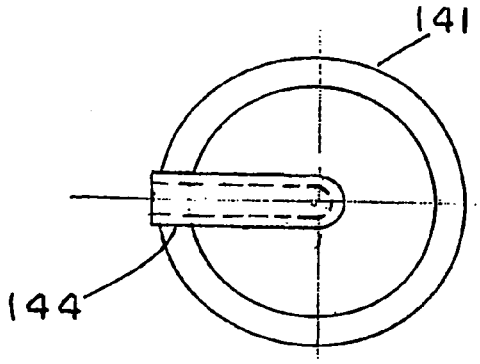
FIG. 38 is a top view of the automatic dispensing cap shown in FIG. 37.

The class 2 vented automatic dispensing cap shown in FIGS. 37 and 38 has cap 141, dispensing hole 142, outlet port 143 and side outlet spout 144.

When the upright bottle 124 is squeezed, the product will flow through dispensing hole 142 as described previously for class 2 vented automatic dispensing cap shown in FIG. 36. From dispensing hole 142, the product will flow through outlet port 143 and exit spout 144. During the squeezing action, the product is dispensed into the palm of the consumer's hand. For very low viscosity products, a port that is angled slightly upward may be used to prevent dripping.

Figure 39:
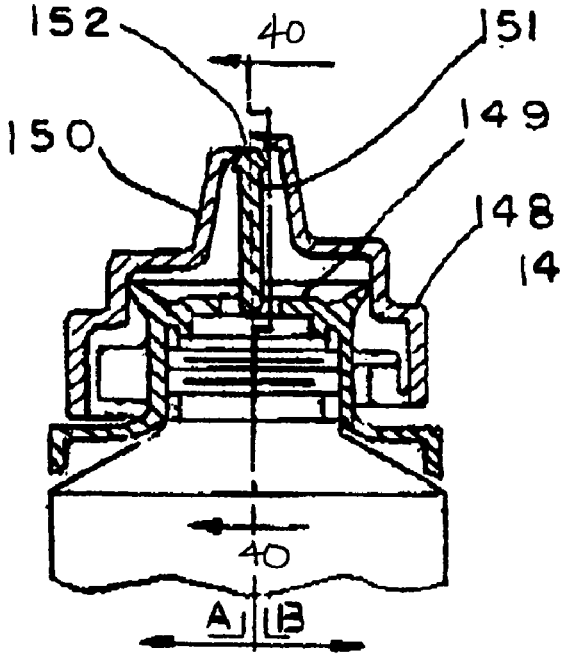
FIG. 39 is a section through a removable two-piece non-vented nozzle type automatic dispensing cap. Side A shows the automatic dispensing cap in the sealed and locked position. Side B shows the automatic dispensing cap during the dispensing cycle.
Figure 40:
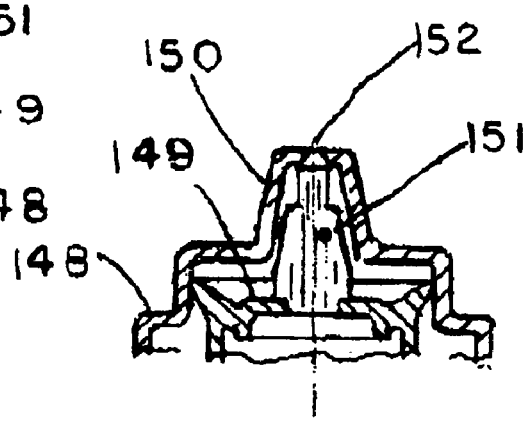
FIG. 40 is a section taken along the section line 40—40 of FIG. 39 showing the configuration of the body and integral shut off valve.

The automatic dispensing cap in FIG. 39 has a cap 148 with an extended nozzle 150. Body 149 has valve extension and integral valve 151. Valve 151 is configured to seat in tapered dispensing hole 152 of nozzle 150. The operation of the automatic dispensing cap in FIG. 39 is identical to the operation of the automatic dispensing cap in FIG. 26. The locking feature is also the same.

The valve that is integral with the piston or body can be configured to suit the application. The drawings disclose a flat face seal, a spherical faced seal and a tapered seal.

It should be noted that all configurations of the automatic dispensing cap could use either the coil spring or the leaf spring design and the associated locking arrangement. It should also be noted that a class 2 vented automatic dispensing cap could be used as a class 1 (inverted), vented automatic dispensing cap by eliminating tube 85.

A resilient material, such as plastic is used to create the automatic dispensing cap. The material selected must have the necessary stress relaxation times and rates to perform as described herein.

Many features have been listed with particular configurations, options, and embodiments. Any one or more of the features described may be added to or combined with any of the other embodiments or other standard devices to create alternate combinations and embodiments.

Although the examples given include many specificities, they are intended as illustrative of only one possible embodiment of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

What is claimed is:

1. An automatic dispensing cap for use with a container holding a fluid product, said automatic dispensing cap comprising:

a body having a connector configured to attach said body to the container, a retainer cap having an interior surface, said cap connecting with said body, a sealing lip configured to contact an interior surface of said retainer cap, a pressure chamber created within said retainer cap, a dispensing hole exiting said pressure chamber, a protrusion, said automatic dispensing cap having a first position and a second position, wherein in said first position, said protrusion seals said dispensing hole, and in said second position said dispensing hole is open, and spring biased to hold said protrusion in said first position.

2. The automatic dispensing cap of claim 1, wherein said spring takes the form of at least one resilient flange extending from one of said body and said retainer cap.

3. The automatic dispensing cap of claim 2, wherein said resilient flange engages a lug extending from one of said body and said retainer cap.

4. The automatic dispensing cap of claim 1, wherein said spring takes the form of a coil spring.

5. The automatic dispensing cap of claim 1, wherein said dispensing opening passes through a wall of said retainer cap.

6. The automatic dispensing cap of claim 1, wherein said sealing lip extends from said body.

7. The automatic dispensing cap of claim 1, further comprising a piston located at least partially within said retainer cap, said sealing lip and said protrusion extending from said piston.

8. The automatic dispensing cap of claim 7, wherein said piston is hollow and has an opening leading from an interior of the container into said pressure chamber.

9. The automatic dispensing cap of claim 1, further comprising a opening extending through said body from an interior of the container into said pressure chamber.

10. The automatic dispensing cap of claim 1, wherein said automatic dispensing cap has locked position and an unlocked position, wherein, when said automatic dispensing cap is in said locked position said protrusion is held in said dispensing opening.

11. The automatic dispensing cap of claim 10, wherein said automatic dispensing cap is rotatable between said locked position and said unlocked position.

12. The automatic dispensing cap of claim 1, further comprising a vent opening extending through said body into the container.

13. The automatic dispensing cap of claim 1, further comprising a vent opening extending through said body into said pressure chamber.

14. The automatic dispensing cap of claim 1, further comprising a tube having a first end and a second end, said first end locatable within the container proximate a bottom thereof and said second end being connected to a port into said pressure chamber.

15. An automatic dispensing cap for use with a container holding a fluid product, said automatic dispensing cap comprising:

a body having an opening extending from an interior of said container and a connection means for attaching said body to the container, a retainer cap having an interior surface, said retainer cap connecting with said body, a sealing lip extending from said body and configured to contact an interior surface of said retainer cap, a pressure chamber created between said retainer cap and said body, a dispensing hole extending through said retainer cap from said pressure chamber, a protrusion extending from said body, said automatic dispensing cap having a first position and a second position, wherein in said first position, said protrusion seals said dispensing hole in said retainer cap, and in said second position said dispensing hole is open, and a flange biased to hold said automatic dispensing cap in said first position.

16. The automatic dispensing cap of claim 15, wherein said automatic dispensing cap has locked position and an unlocked position, wherein, when said automatic dispensing cap is in said locked position said protrusion is held in said dispensing opening.

17. The automatic dispensing cap of claim 15, further comprising a vent opening extending through said body.

18. The automatic dispensing cap of claim 15, further comprising a flapper valve located over said vent opening.

19. The automatic dispensing cap of claim 15, further comprising a tube having a first end and a second end, said first end locatable within the container proximate a bottom thereof and said second end being connected to a port into said pressure chamber.

20. An automatic dispensing cap for use with a container holding a fluid product, said automatic dispensing cap comprising:

a body having a connection means for attaching said body to the container, a retainer cap connected to the body and having an interior surface, a pressure chamber enclosed by said body and said retainer cap, a dispensing hole exiting said pressure chamber, a piston, a valve on said piston, said valve being sized and configured to seal said dispensing hole, wherein said piston has a first position and a second position, wherein in said first position, said valve seals said dispensing hole, and in said second position said dispensing hole is open, a sealing lip around a perimeter of said piston, said sealing lip configured to contact said interior surface of said retainer cap, and a spring biased to hold said piston in said first position.

* * * * *